US005525069A

United States Patent [19]

Roscizewski et al.

[11] Patent Number: 5,525,069

[45] Date of Patent: Jun. 11, 1996

[54] ELECTRICAL CONNECTOR

[75] Inventors: Paul M. Roscizewski, Eagle; Russell J. Lenz; Todd K. Knapp, both of Waukesha, all of Wis.

[73] Assignee: Cooper Industries, Inc., Houston, Tex.

[21] Appl. No.: 448,018

[22] Filed: May 23, 1995

Related U.S. Application Data

[60] Division of Ser. No. 130,651, Oct. 1, 1993, Pat. No. 5,445,533, which is a continuation-in-part of Ser. No. 943,442, Sep. 10, 1992, Pat. No. 5,277,605.

[51] Int. Cl.[6] ..... H01R 13/53

[52] U.S. Cl. ..... 439/184; 439/921

[58] Field of Search ..... 439/181–187, 439/587, 693, 886, 921

[56] References Cited

U.S. PATENT DOCUMENTS

| | | | |
|---|---|---|---|
| 3,930,709 | 1/1976 | Stanger et al. . | |
| 3,957,332 | 5/1976 | Lambert, III . | |
| 4,170,394 | 10/1979 | Conway . | |
| 4,186,985 | 2/1980 | Stepniak et al. . | |
| 4,600,260 | 7/1986 | Stepniak et al. . | |
| 4,713,018 | 12/1987 | Sutton | 439/185 |
| 4,773,872 | 9/1988 | Borgstrom et al. | 439/185 |
| 4,863,392 | 9/1989 | Borgstrom et al. | 439/185 |

OTHER PUBLICATIONS

The 25 kV Bushing Insert By Cooper Power Systems, 1989 (4 pages) .

200 A 15 kV Class Loadbreak Bushing Insert by Cooper Power Systems, Jan. 1990 (2 pages) .

Loadbreak Bushing Insert 1601A4 by Elastimold, date unknown; (1 page) .

*Primary Examiner* Khiem Nguyen

*Attorney, Agent, or Firm* Conley, Rose & Tayon

[57] ABSTRACT

The electrical connector of the present invention includes an electrically conductive sleeve having a passage therethrough and an elastomeric housing molded therearound. After the molding of the housing around the sleeve, a contact element is disposed within the passage of the sleeve for engagement with the contact member of another connector. An arc snuffer housing and arc snuffer are attached to one end of the contact element for guiding the contact member toward the contact element and for evolving an arc-quenching gas in response to an arc being struck between the contact member and the contact element. The contact element includes a piston member responsive to the evolved gas for jointly displacing within said passage the arc snuffer and contact element toward the contact member. A support member is provided within the sleeve for reciprocably supporting the piston member of the contact element. The piston member includes a friction surface to inhibit the movement of the piston member within the conductive sleeve until a predetermined pressure is achieved by the arc-quenching gas and for electrically engaging the piston member with the conductive sleeve for providing electrical continuity therebetween. The support means includes a stop and a plurality of restrictions to inhibit and stop the longitudinal movement of the piston member.

14 Claims, 11 Drawing Sheets

ELECTRICAL CONNECTOR

RELATED APPLICATION

This is a divisional continuing application of copending application Ser. No. 08/130,651 filed Oct. 1, 1993 now U.S. Pat. No. 5,475,533 which is a continuation-in-part of Ser. No. 07/943,442 filed Sep. 10, 1992 now U.S. Pat. No. 5,277,605.

BACKGROUND OF THE INVENTION

This invention relates to electrical connectors, and, more particularly, to separable electrical connectors suited for use under high-voltage conditions. Still more particularly, this invention relates to gas actuated high-voltage bushings having a contact mounted within a bore for reciprocal movement within a bushing housing.

High-voltage separable connectors interconnect sources of energy such as transformers to distribution networks or the like. The situations typically encountered in the connection and disconnection of electrical connectors and power distributions include "loadmake", "loadbreak", and "fault closure". Loadmake includes the joinder of male and female contact elements, one energized and the other engaged with a normal load. An arc of moderate intensity is struck between the contact elements as they approach one another and until joinder. Loadbreak includes the separation of such mated male and female contact elements, while they supply power to a normal load. Moderate intensity arcing again occurs between the contact elements from the point of separation thereof until they are somewhat removed from one another. Fault closure includes the joinder of male and female contact elements, one energized and the other engaged with a load having a fault, e.g., a short circuit condition. A substantial arcing occurs between the contact elements as they approach one another and until joinder, giving rise to the possibility of explosion and accompanying hazard to operating personnel.

The prior an teaches the use of materials which emit arc-quenching gas when subjected to arcing, thus adequately dissipating the moderate intensity of arcs which occur during loadmake and loadbreak. The problem situation is fault closure, in which considerably more arc-quenching gas and mechanical assistance are required to extinguish the arc. During fault closure, the gas generated pressures may be fifty times greater than such pressures during loadmake. With respect to fault closure, the prior art has relied upon the use of the arc-quenching gas to assist in accelerating the contact elements into engagement, thus minimizing arcing time.

A typical prior art electrical connector includes a bushing well connected to the transformer, a bushing insert which contains a female contact assembly connected to the well, and an elbow connected to a distribution line and containing a male contact to join an insert female contact in the female contact assembly. Because closure of the male and female contacts can occur under activated conditions or under fault conditions, the female contact is arranged to move within the insert to hasten the closure of the male and female contacts and thus extinguish any arc created. However, it is necessary to maintain electrical continuity during the travel of the female contact assembly. The connection between such female contact assembly and the remainder of the bushing insert must be flexible so as not to impede its movement but sufficient to carry the high currents in the circuit. Typical prior art devices include a female contact which has a piston that is moveable between a first and second position. Gas pressure which is generated by arcing during fault closure accelerates the female contact toward the male contact, thus hastening contact engagement and decreasing the time duration of the arc. Mechanisms for achieving these results have not always produced sufficient current paths causing the connectors to run hot, and interfering with proper operation of the distribution network and in the extreme, leading to the destruction of the bushing inserts.

SUMMARY OF THE INVENTION

The present invention includes a female electrical connector comprising a conductive housing having a first end adapted to receive a male contact element, a second end adapted to be closed, and an internal wall surface providing an axially extending opening therebetween. The connector includes an elongate female contact assembly including a tubular conductive piston mounted on a holder within and in conductive relationship with the housing and axially moveable between a normal or first position wherein the piston is maximally spaced from the first housing end and a second position. The piston provides a chamber adjacent the second housing end. The assembly also includes female contact means for engaging the male contact element carried by and moveable with and in electrically conductive relationship with the piston. The female contact assembly is configured to transmit to the chamber arc-quenching gas which is generated when an arc is struck between the male contact element and the female contact means. The predetermined value of gas pressure is associated only with fault closure so that the piston is retained by the mechanism in the first position except during fault closure.

The female contact assembly includes frictional and mechanical inhibitors for retaining the piston in the first position until gas pressure in the chamber attains a predetermined value and for releasing the piston to cause the same to move toward the second position when said pressure exceeds said predetermined value. The inhibitors include a knurled surface on the piston which engages the holder of the piston; dimples in the holder crimping the holder against members are disposed on the holder for engaging a stop shoulder on the piston and stops are disposed on the holder for engaging the stop shoulder on the piston. The wedge members reduce the velocity of the movement of the piston toward the stops on the holder with the stops preventing farther movement of the piston.

Other objects and advantages of the present invention will appear from the following description.

BRIEF DESCRIPTION OF THE DRAWINGS.

For a detailed description of a preferred embodiment of the invention, reference will now be made to the accompanying drawings wherein.

DESCRIPTION OF A PREFERRED EMBODIMENT

Figure 1:
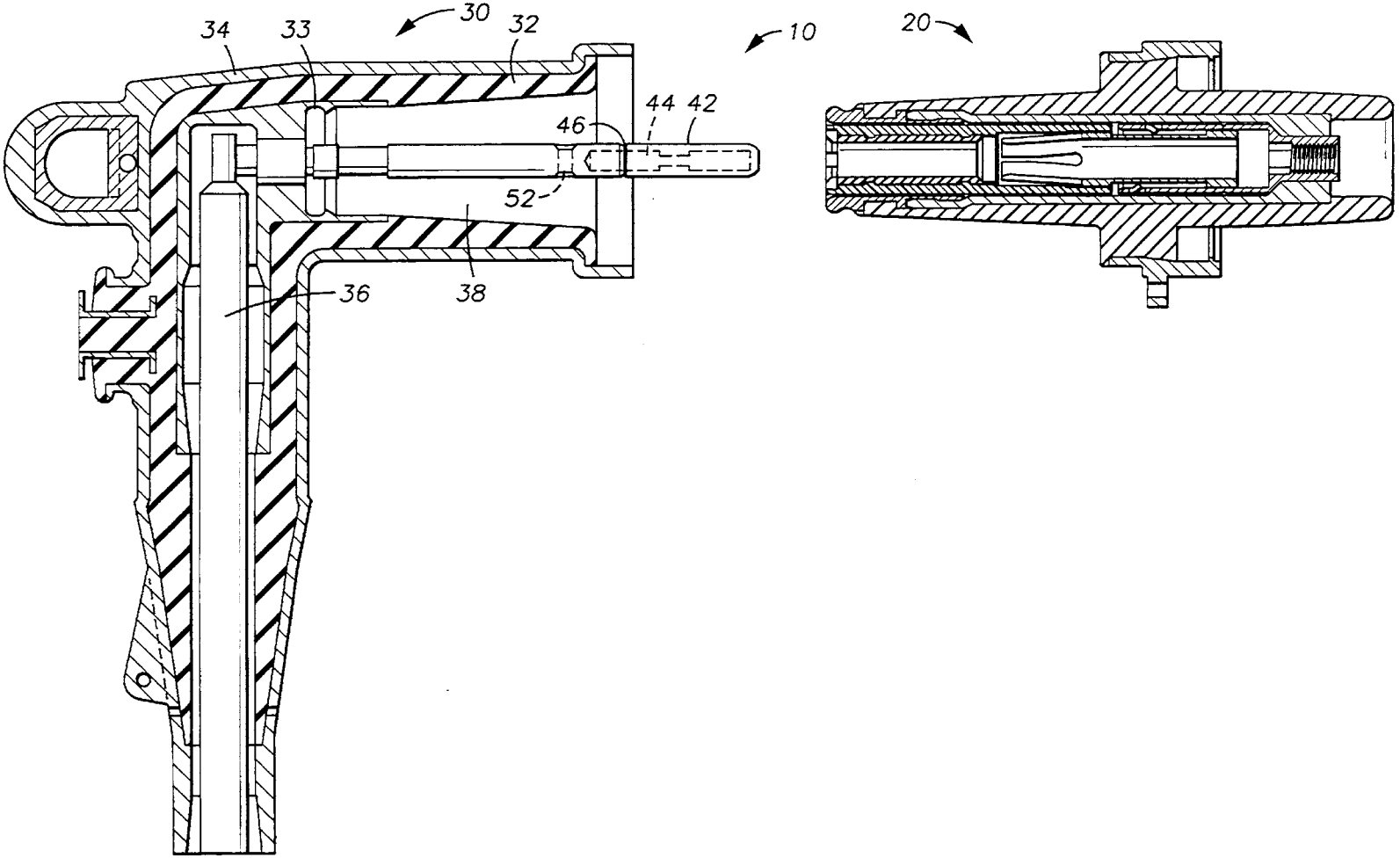
FIG. 1 is a longitudinal cross-section view of a male electrical contact connector to be inserted into a female electrical contact connector.

Referring initially to FIG. 1, the electrical connector 10 of the present invention includes a female contact connector 20, as for example a bushing insert or connector, connected to a portion of a high-voltage circuit (not shown), and a male contact connector 30, such as an elbow connector, electrically connected to another portion of the high-voltage circuit. As shown, the male contact connector 30 is in the form of a cable termination device, such as an elbow. Male and female contact connectors 30, 20, respectively interfit to achieve electrical connection.

The male connector 30 includes an elastomeric housing 32 of a material such as EPDM (ethylene-propylene-dien-emonomer) rubber which is provided on its outer surface with a conductive shield layer 34 which is grounded (not shown). One end of a male contact element or probe 40, of a material such as copper; extends from a conductor contact 36 within housing 30 into a cup shaped recess 38 of housing 32. At the opposite end of the male contact element 40 extends an are follower 42 of ablative material. A preferred ablative material for are follower 42 is acetal co-polymer resin loaded with finely divided melamine. The ablative material is typically injection molded on an epoxy bonded glass fiber reinforcing pin 44. A recess 46 is provided at the junction between metal rod 40 and arc follower 42. An aperture 52 is provided through the exposed end of rod 40 for the purpose of assembly.

Referring now to FIGS. 1–7 illustrating the female connector 20, female contact connector 20 is a bushing insert composed of a shield assembly having an elongated body including an inner rigid, metallic, electrically conductive sleeve 50, sometimes referred to as a shield tube, having a non-conductive nose piece 52 secured to one end of sleeve 50 by latching means 54, and a easing 56 of elastomeric insulating material such as rubber, synthetic rubber, plastic or the like surrounding and bonded to the outer surface of sleeve 50 and a portion of nose piece 52. A radially outer portion 58 of conductive elastomeric material is bonded to the midportion 55 of casing 56, all well known in the art. Bushing insert 20 is electrically and mechanically mounted to a bushing well (not shown) disposed on the enclosure of a transformer or other electrical equipment. For purposes of description, the term "inner" shall mean the direction toward the bushing well of the electrical equipment and the term "outer" shall mean the direction toward the nose piece 52 and male connector 30.

Conductive sleeve 50 is generally cylindrical having a central passageway 60 therethrough. Sleeve 50 has an inner end 62 which has a reduced inner diameter 63 which is open to recess 64 formed by casing 56 which receives a portion of the bushing well (not shown). The open outer end 66 of conductive sleeve 50 includes an enlarged outer diameter 67 with a radially inwardly directed annular latching shoulder 69 forming an annular latching groove 71. Latching shoulder 69 and latching groove 71 form a part of latching means 54.

Nose piece 52 has an external circumferential groove 68 which serves as a securing detente for complimentary fibbed portion 33 associated with elastomeric housing 32 of male contact connector 30. The inner end 53 of nose piece 52 has a reduced outer diameter with a radially, outwardly projecting annular shoulder 55 for abutting the outer terminal end 66 of conductive sleeve 50. Inner end 53 includes a radially, outwardly directed annular shoulder 57 adapted for being received by latching groove 71 and an outwardly facing annular latching groove 59 adapted for receiving annular latching shoulder 69. Annular shoulder 59 and latching groove 59 form the remainder of latching means 54.

Figure 2:
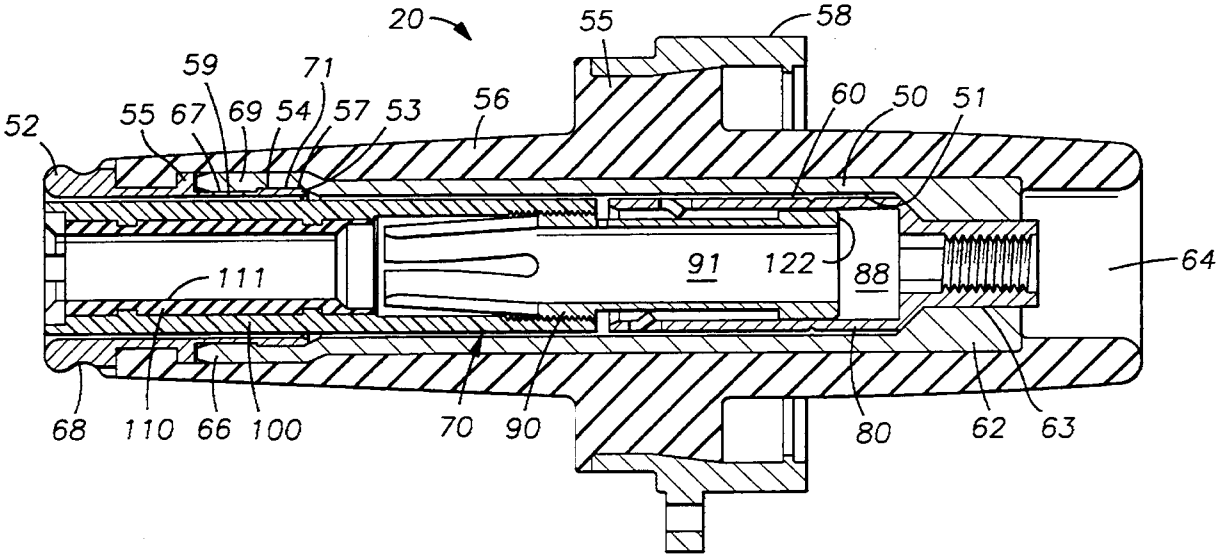
FIG. 2 is an enlarged cross-sectional side elevational view of the female contact connector shown in FIG. 1.
Figure 3:
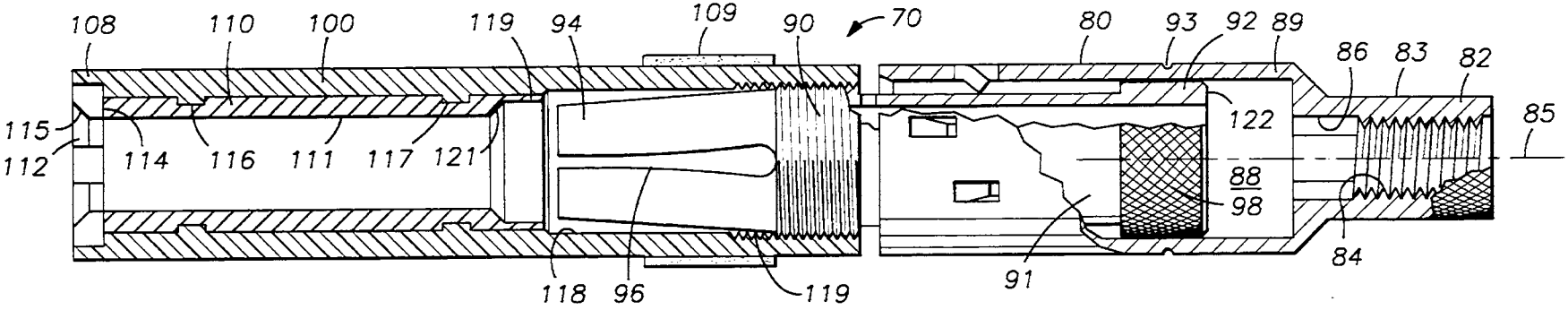
FIG. 3 is an enlarged cross-sectional side elevational view of the female contact assembly of the connector shown in FIG. 2.

Referring now particularly to FIGS. 2 and 3, the female contact connector 20 further includes a contact assembly 70. Contact assembly 70 includes a contact holder 80, a female contact 90, a tubular arc snuffer housing 100, and an arc-quenching, gas-generating arc snuffer 110. As best shown in FIG. 2, the contact assembly 70 is disposed within internal passageway 60 of conductive sleeve 50. Contact holder 80 is generally cylindrical and has a substantially closed inner end 82 which is disposed within reduced diameter inner end 62 of conductive sleeve 50. The external shape of contact holder 80 conforms to the generally cylindrical shape of the internal wall 51 of conductive sleeve 50. The inner end of contact holder 80 is knurled at 83 and then press fitted into reduced diameter 63 of inner end 62 of conductive sleeve 50. A cooperating snap ring and groove may be used to maintain inner end 82 within end 62 of sleeve 50.

The inner rigid, metallic, electrically conductive sleeve 50 acts as an equal potential shield around the contact assembly 70 disposed within internal passageway 60 of sleeve 50. A sleeve made of a nonconductive material would not provide such a shield. It is preferred that sleeve 50 be made of an electrically conductive material so as to act as an equal potential shield and prevent any stress of the air within the sleeve 50 and prevent any air gaps around the contact assembly 70. It is desirable to prevent any breakdown of the air within the connector housing during normal assembled operation.

A threaded aperture 84 extends longitudinally through closed inner end 82 along the central axis 85 of sleeve 50. To permit the female contact connector 20 to be electrically and mechanically coupled to a bushing well (not shown), a hex slot 86 is provided in inner end 82 to receive a hexrod extending through contact assembly 70 for the turning of female contact connector 20 to threadingly engage a stud (not shown) extending from the bushing well mounted on the electrical equipment.

The cylindrical portion of contact holder 80 forms a cylinder or bore 88 sized for receiving one end of female contact 90. Female contact 90 is generally cylindrical and includes a piston or barrel 92 having a plurality of projecting contact fingers 94 extending from its outer end. Contact fingers 94 are formed by providing a plurality of slots 96 azimuthally spaced around the outer end of female contact 90. Contact fingers 94 are shown in the contracted position in FIG. 3 and are moved to an expanded position upon the insertion of probe 40 as hereinafter described with respect to FIG. 4.

The inner end 91 of female contact 90 is knurled at 98 around its outer circumferential surface to provide a frictional, biting engagement with the cylindrical wall 89 of contact holder 80. This knurled interface 98 provides substantial friction and thus drag between female contact 90 and contact holder 80. The knurled surface 98 not only ensures good electrical contact between holder 80 and contact 90, but also inhibits the reciprocation of the piston or barrel 92 of contact 90 within the cylinder or bore 88 of holder 80 until such friction is overcome by gas pressure forces as hereinafter described. To provide additional resistance to the movement of contact 90 within holder 80, a plurality of stakes or dimples 93, such as three, may be made in the cylinder wall 89 and into barrel 92 at knurled surface 98.

Figure 6:
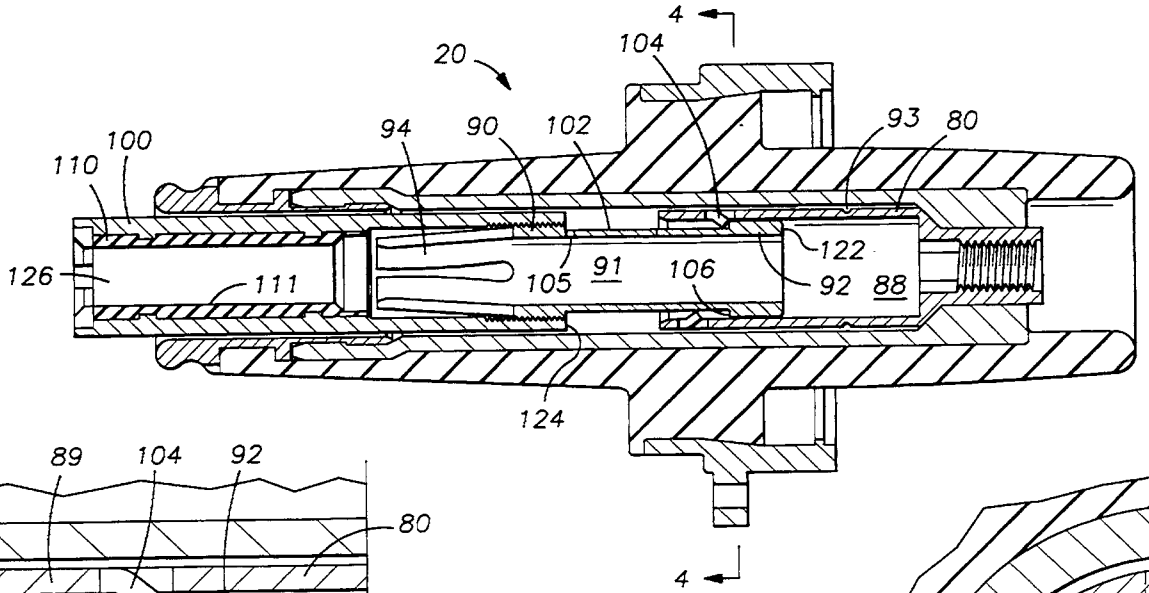
FIG. 6 is a cross-sectional side elevational view of the female contact connector of FIG. 2 in the outward, expanded position.
Figure 4:
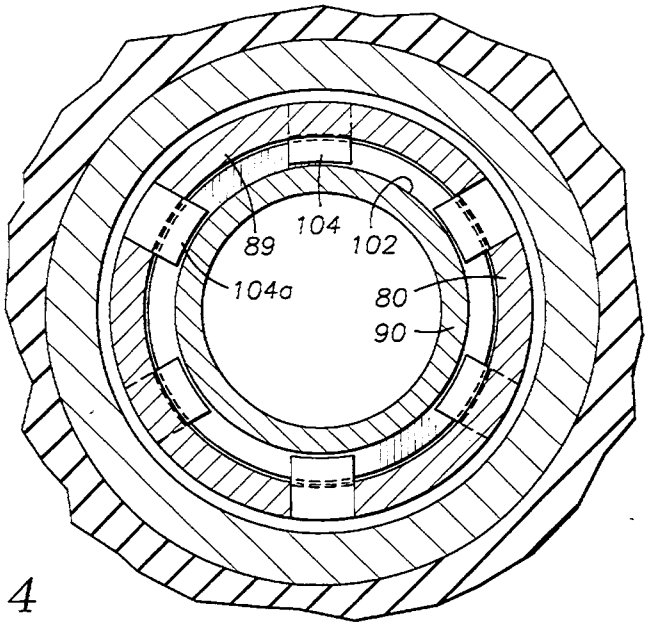
FIG. 4 is an enlarged cross-sectional view at plane 4—4 of FIG. 6 illustrating stops.
Figure 5:
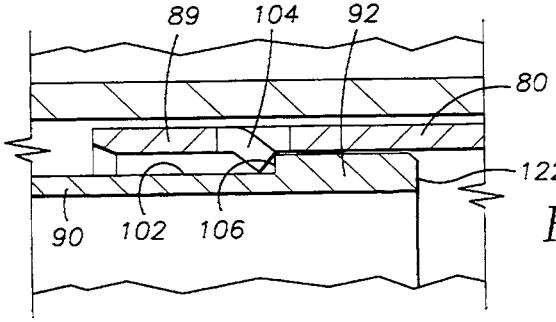
FIG. 5 is an enlarged view of a portion of FIG. 6 illustrating stops.

Referring now to FIGS. 3–6, the barrel 92 of female contact 90 further includes an annular counterbore 102 around its mid-portion forming an outwardly facing annular shoulder 106. As best shown in FIG. 5, upon the assembly of female contact 90 within the bore 88 of contact holder 80, laced stops 104 are formed by crimping a plurality of inwardly directed tabs formed in the cylindrical wall 89 of holder 80 so as to project radially inward such that stops 104 are received within counterbore 102. Lanced stops 104 preferably include two circumferential rows of four stops each approximately 90° apart. The outer row of stops **104*a* is staggered with the inner row of stops 104 so as to be 45° apart. Stops 104 are provided to engage annular stop shoulder 106 of counterbore 102 upon the outward movement of female contact 90 away from inner closed end 82 of holder 80 as shown in FIG. 6. Further, vent holes 105, preferably two in number, are provided through the wall of counterbore 102** adjacent its outer end.

Figure 7:
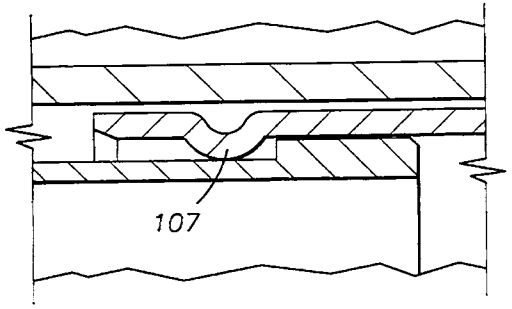
FIG. 7 illustrates an alternative embodiment of the stops shown in FIG. 5.

Referring now to FIG. 7, stops 104 may alternatively be formed by providing an annular indentation 107 which is mechanically formed by rollers passing around the external surface of cylindrical wall 89 of contact holder 80. The protrusion of lanced stops 104 or annular indentations 107 and their projection into bore 88 may be varied to adjust the contact of stops 104 or indentation 107 against the annular bottom surface of counterbore 102. This adjustment may be used to vary the frictional and mechanical engagement between barrel 92 and the bore 88 of holder 80 to thereby assist in changing the force required to move female contact 90 within contact holder 80.

Referring again to FIG. 3, arc snuffer 110 is generally cylindrical and includes two annular grooves 116, 117. The inner end 119 has an enlarged diameter with the diameter change forming an inwardly facing frusto-conical shoulder 12 1. The enlarged diameter on the inner end 119 of arc snuffer 100 provides additional volume within bore 88 for the pressure generated by the arc-quenching gas. Arc snuffer housing 100 is made of plastic and is molded around arc snuffer 110. Outer terminal end 108 of arc snuffer housing 100 includes a plurality of guides 112, preferably four in number, azimuthally spaced around end 108. Guides 112 form an inwardly directed annular stop shoulder 114 and an outwardly facing inwardly tapering guide surface 115 to guide probe 40 into contact assembly 70. During the molding process, annular grooves 116, 117 receive molded plastic which form annular ribs received within grooves 116, 117 to lock arc snuffer 110 within housing 100.

The inner end 118 of housing 100 is adapted to receive the projecting contact fingers 94 of female contact 90. Housing 100 includes threads 119 along a portion of inner end 118 for threaded engagement with external threads on female contact 90. Alternatively, inner end 119 may be heated by induction heat with the plastic of inner end 118 melting around preferably a knurled surface of female contact 90 to attach the arc snuffer assembly to female contact 90. In securing the arc snuffer assembly to female contact 90, the arc snuffer assembly and female contact 90 move as a unit within conductive sleeve 50 and contact holder 80.

One of the advantages of the present invention is that the casing 56 may be molded to the exterior of nose piece 52 and conductive sleeve 50 without having contact assembly 70, or a portion thereof, previously installed within conductive sleeve 50. One disadvantage of the prior art is the molding of the housing after one or more parts of the contact assembly has already been installed such that the heat from the molding process adversely affects the components housed within the sleeve.

Prior to the assembly of contact assembly 70 within aperture 60 of conductive sleeve 50, a foam tape 109 is wrapped around the outer circumference of arc snuffer housing 100. Upon the assembly of contact assembly 70 within conductive sleeve 50, foam tape 109 is contracted into sealing engagement between the adjacent surfaces of housing 100 and conductive sleeve 50 to prevent the passage of the arc-quenching gas generated during a switching operation between contact assembly 70 and conductive sleeve 50. Thus, the pressure of the arc-quenching gas is all directed against the contact assembly 70 to move assembly 70 into the outward extended position shown in FIG. 6 during a fault condition.

Referring now to FIGS. 2 and 6, FIG. 2 illustrates the female contact connector 20 in the normal, contracted operating position. FIG. 6 illustrates the female contact connector 20 in the fault, outward or expanded position. During a loadbreak or switching operation, the male contact connector 30, i.e. elbow and probe assembly, is separated from the female contact connector 20, i.e. bushing insert. During the loadbreak, separation electrical contact occurs between the probe 40 and female contact 90. During this separation as probe 40 is pulled outward from female connector 20, there is a mechanical drag between the probe 40 and contact fingers 94 of female contact 90. This drag might otherwise result in the movement of female contact 90 within contact holder 80, but is prevented from doing so due to the frictional forces at the innerface between knurled surface 98 and the inner circumferential surface of cylindrical wall 89 of contact holder 80 and due to dimples 93 in holder 80 crimping wall 89 against knurled surface 98.

In the joinder of male connector 30 and female connector 20 during loadmake, one connector is energized and the other is engaged with a normal load. Upon the attempted closure of male contact probe 40 with female contact 90, an arc is struck prior to actual engagement of probe 40 with contact fingers 94 and continues until solid electrical contact is made. The arc passes from male contact probe 40 to arc snuffer 110 and passes along the inner circumferential surface 111 of arc snuffer 110 thereby causing the generation of arc-quenching gases. These gases are directed inwardly within the bore 91 of female contact 90 and the bore 88 of contact holder 80. The pressure of these gases applies a force to inwardly facing shoulder 121 of arc snuffer housing 100 and to the inner terminal end 122 of female contact 90. An arc of moderate intensity will not produce adequate gas pressure to apply sufficient force on the end 124 of arc snuffer housing 100, inner end 119 of arc snuffer 110, and terminal end 122 of female contact 90 to overcome the frictional engagement of cylindrical wall 89 and dimples 93 with knurled surface 98.

However, during fault closure, one of the connectors 20, 30 is energized and the other is engaged with a load having a fault, e.g. a short circuit condition. Under such circumstances, a substantial arcing occurs between male contact probe 40 and female contact 90 as probe 40 approaches opening 126 in arc snuffer 110. In fault closure, are snuffer 110 generates substantial arc-quenching gases which produce a gas pressure within bore 88 that is sufficient to act upon shoulder 121 of the arc snuffer assembly and the terminal end 122 of female contact 90 and overcome the frictional engagement of knurled surface 98 with inner wall 89 and dimples 93. This arc-quenching gas pressure moves the entire contact assembly 70, i.e. are snuffer housing 100, are snuffer 110, and female contact 90, toward probe 40 to more quickly establish electrical contact between male contact probe 40 and female contact fingers 94. This accelerated electrical connection reduces the fractional time required to make connection and thus reduces the possibility of explosion and any accompanying hazard to operating personnel during a fault closure situation.

Figure 24:
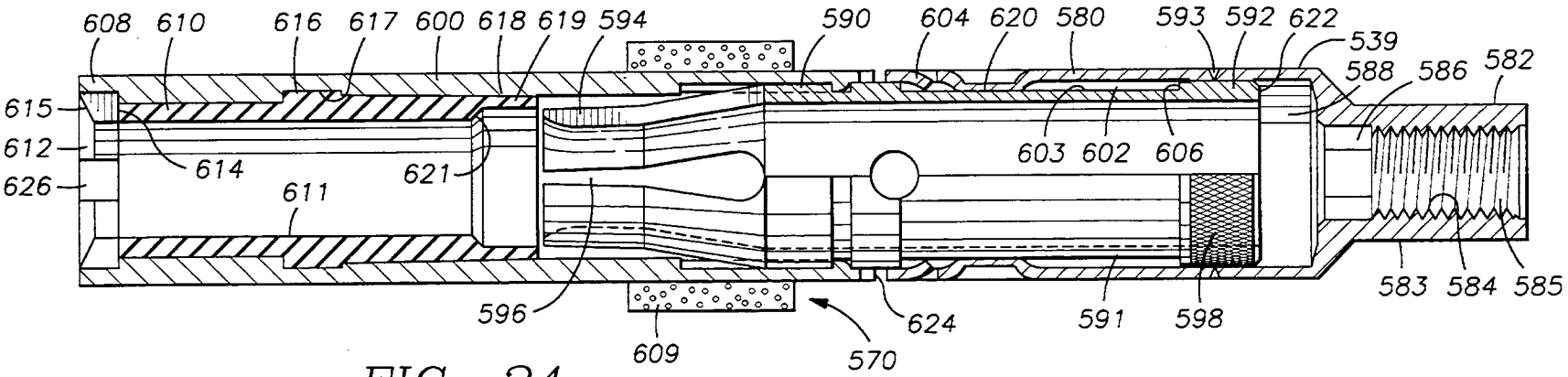
FIG. 24 is an enlarged cross-sectional side elevational view of the preferred embodiment of the female contact assembly of the present invention.
Figure 27:
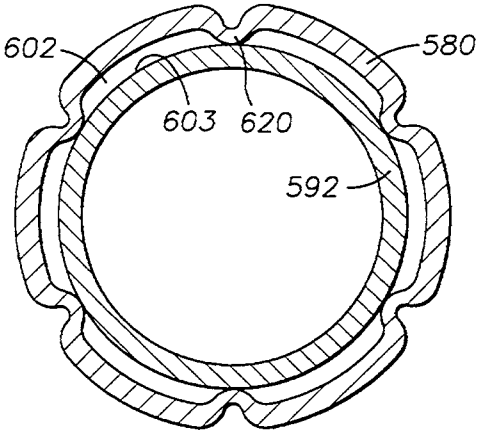
FIG. 27 is a sectional view at plane 27—27 shown in FIG. 25.
Figure 26:
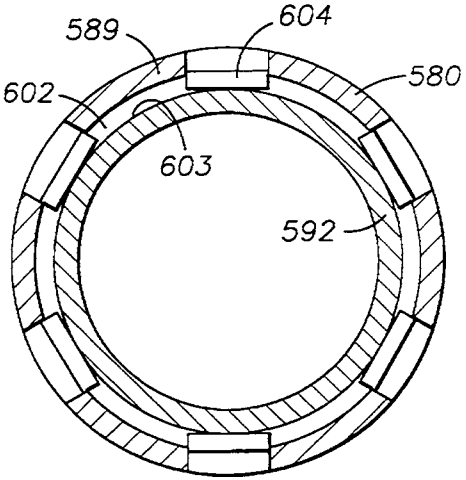
FIG. 26 is a sectional view at plane 26—26 of FIG. 25.
Figure 25:
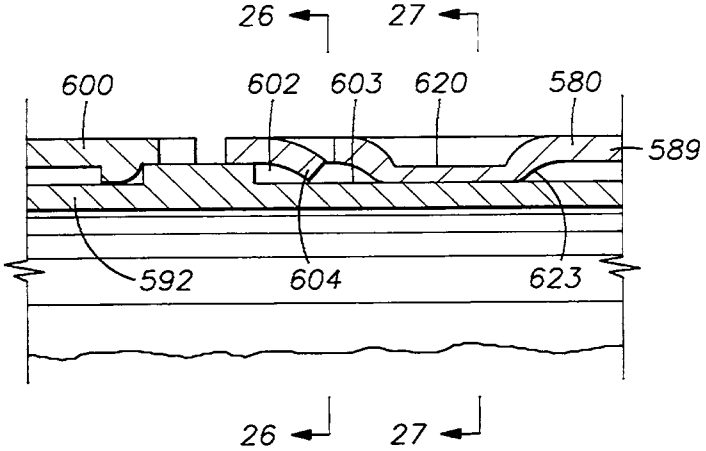
FIG. 25 is an enlarged cross-sectional view of detail "A" shown in FIG. 24.

Referring now to FIGS. 24–26, there is shown the preferred embodiment of the female contact assembly of the female contact connector of the present invention. The female contact connector 500 includes a conductive sleeve, non-conductive nose piece, and a casing which are substantially the same as that of sleeve 50, nose piece 52, and casing 56 shown in the embodiment of FIG. 2. The female contact connector 500, however, includes a preferred contact assembly 570. Contact assembly 570 includes a contact holder 580, a female contact 590, a tubular arc snuffer housing 600, and an arc-quenching, gas-generating arc snuffer 610. The contact assembly 570 is disposed within the internal passageway of a conductive sleeve, substantially the same as that of sleeve 50 of FIG. 2. Contact holder 580 is generally cylindrical and has a substantially closed inner end 582 which is disposed within the reduced diameter inner end of the conductive sleeve. The external shape of contact holder 580 conforms to the generally cylindrical shape of the internal wall of the conductive sleeve. The inner end 582 of contact holder 580 is knurled at 583 and then press fitted into the reduced diameter of the inner end of the conductive sleeve. A cooperating snap ring and groove may be used to maintain inner end 582 within the inner end of the conductive sleeve.

A threaded aperture 584 extends longitudinally through closed inner end 582 along the central axis 585 of the conductive sleeve. To permit the female contact connector to be electrically and mechanically coupled to a bushing well (not shown), a hex slot 586 is provided in inner end 582 to receive a hex rod extending through contact assembly 570 for the turning of the female contact connector to threadingly engage a stud (not shown) extending from the bushing well mounted on the electrical equipment.

Arc snuffer 610 is generally cylindrical and includes an outwardly projecting annular rib 616. The inner end 619 has an enlarged diameter with the diameter change forming an inwardly facing frusto-conical shoulder 621. The enlarged diameter on the inner end 619 of arc snuffer 610 provides additional volume within bore 588 for the pressure generated by the arc-quenching gas. Arc snuffer housing 600 is made of plastic and is molded around arc snuffer 610. Outer terminal end 608 of arc snuffer housing 600 includes a plurality of guides 612 azimuthally spaced around end 608. Guides 612 form an inwardly directed stop shoulder 614 in an outwardly facing inwardly tapering guide surface 615 to guide probe 40 into contact assembly 570. During the molding process, annular rib 616 is surrounded by molded plastic which forms an annular groove 617 to lock arc snuffer 610 within housing 600. Arc snuffer 610 also includes an inwardly tapering outer conical surface 618.

As described with respect to FIGS. 1–7, a foam tape 609 is wrapped around the outer circumference of arc snuffer housing 600 to provide sealing engagement between the adjacent surfaces of housing 600 and the outer conductive sleeve to prevent the passage of arc-quenching gas generated during a switching operation between contact assembly 570 and the conductive sleeve. Thus, the pressure of the arc-quenching gas is all directed against contact assembly 570 to move assembly 570 into the outward extended position during a fault condition.

The cylindrical portion of contact holder 580 forms a cylinder or bore 588 sized for receiving one end of female contact 590. Female contact 590 is generally cylindrical and includes a piston or barrel 592 having a plurality of projecting contact fingers 594 extending from its outer end. Contact fingers 594 are formed by providing a plurality of slots 596 azimuthally spaced around the outer end of female contact 590. Contact fingers 594 are shown in the contracted position in FIG. 24 and are moved to an expanded position upon the insertion of probe 40 as previously described. Further, vent holes may be provided through the wall of barrel 592 adjacent its outer end.

The inner end 591 of female contact 590 is knurled at 598 around its outer circumferential surface to provide a frictional, biting engagement with the cylindrical wall 589 of contact holder 580. A plurality of dimples 593, preferably two which are 180° apart, are made in the outer surface of cylindrical wall 589 and project into the knurled surface 598 of barrel 592. Dimples 593 have a 60° included angle. The knurled surface 598 and dimples 593 provide substantial friction and thus drag between female contact 590 and contact holder 580. The knurled surface 598 and dimples 593 not only ensure good electrical contact between holder 580 and contact 590, but also inhibit the reciprocation of the piston or barrel 592 of contact 590 within the cylinder or bore 588 of holder 580 until such friction is overcome by gas pressure forces as hereinafter described.

Referring now to FIGS. 24–27, the barrel 592 of female contact 590 further includes an annular counterbore 602 around its mid-portion forming an outwardly facing annular shoulder 606. Upon the assembly of female contact 590 within the bore 588 of contact holder 580, lanced stops 604 are formed by crimping a plurality of inwardly directed tabs formed in the cylindrical wall 589 of holder 580 so as to project radially inward such that stops 604 are received within counterbore 602. Lanced stops 604 preferably include eight inwardly directed tabs azimuthally spaced in a row around the outer circumference of cylindrical wall 589 of holder 580. Stops 604 are provided to engage annular stop shoulder 606 of counterbore 602 upon the outward movement of female contact 590 away from inner closed end 582 of holder 580.

A plurality of wedges or stakes 620 are formed in the cylindrical wall 589 of contact holder 580. There are preferably six stakes disposed azimuthally around the outer circumference of cylindrical wall 589. Stakes 620 are longitudinal indentations in cylindrical wall 589 with the longitudinal axis of each stake 620 being parallel to axis 585. Upon the formation of stake 620, a ramp or inclined surface 623 is formed facing annular stop shoulder 606 on barrel 592. Although stakes 620 appear to be in alignment with stops 604, such alignment is shown for illustration purposes only since stakes 620 may or may not be in alignment. In the preferred embodiment, the six stakes 620 are not in alignment with the eight stops 604. Although not shown in FIG. 27, during the formation of stakes 620, stakes 620 may be coined or embedded into the bottom surface 603 of counterbore 602.

The protrusion of lanced stops 604 and stakes 620 and their projection into counterbore 602 may be varied to adjust the contact of stops 604 and/or stakes 620 against the annular bottom surface 603 formed by counterbore 602. This adjustment may be used to vary the frictional and mechanical engagement between barrel 592 and holder 580 to thereby assist in changing the force required to move female contact 590 within contact holder 580. In such a case, lanced stops 604 and stakes 620 would provide a further frictional and mechanical engagement between contact 590 and contact holder 580 to inhibit the reciprocation of the piston or barrel 592 of contact 590 within the cylinder or bore 588 of contact holder 580 until such frictional and mechanical engagement is overcome by gas pressure forces as hereinafter described.

Stakes 620 further provide wedge means in the form of ramp or inclined surface 623 to retard and slow the longitudinal movement of outwardly facing annular stop shoulder 606 on barrel 592 toward lanced stops 604. Once contact 590 overcomes the frictional and mechanical engagement of contact 590 within contact holder 580 due to the gas pressure forces, annular stop shoulder 606 will engage the inclined surfaces 623 of stakes 620. Further movement of stop shoulder 606 toward lance stops 604, causes shoulder 606 to become wedged under stakes 620 which restrict the clearance through counterbore 602 for the passage of barrel 592. Sufficient gas pressure forces will cause stop shoulder 606 and barrel 592 to pass underneath stakes 620 whereby stop shoulder 606 will engage lanced stops 604 to prevent further outward longitudinal movement of contact 590 within contact holder 580. The wedging and retarding of the movement of barrel 592 either stops the movement of contact 590 within contact holder 580 or prevents barrel 592 from engaging stops 604 with such velocity and force so as to shear stops 604 and possibly allow contact 590 to pass completely out of bore 588 of contact holder 580.

The use of stakes 620 as a wedge means against stop shoulder 606 and barrel 592 allow a longer prestrike or arc to be generated by the contact between the probe 40 and contact 590. A longer prestrike generates greater energy in the form of greater gas pressure forces which may not only overcome the frictional and mechanical engagement between contact 590 and holder 580 but also thrust stop shoulder 606 on barrel 592 against lanced stops 604. The wedges or stakes 620 absorb a substantial portion of the force which propels contact 590 outwardly within holder 580 and thus allows the female contact connector to absorb greater energy without allowing lanced stops 604 to shear off. Stakes 620 greatly enhance the safety factor in ensuring that contact 590 is not blown out of contact holder 580 due to the generation of large gas pressure forces.

FIG. 24 illustrates the female contact assembly 570 in the normal, contracted operating position. During a loadbreak or switching operation, the male contact connector 30, i.e. elbow and probe assembly, is separated from the female contact connector, i.e. bushing insert. During the loadbreak, separation electrical contact occurs between the probe 40 and female contact 590. During the separation as probe 40 is pulled outward from female contact assembly 570, there is a mechanical drag between the probe 40 and contact fingers 594 of female contact assembly 570. This drag might otherwise result in the movement of female contact 590 within contact holder 580, but is prevented from doing so due to inhibitor means including the frictional and mechanical forces between the knurled surface 598 and the inner circumferential surface of cylindrical wall 589; the contact of dimples 593 in holder 580 crimping wall 589 against knurled surface 598; the contact between stops 604 and surface 603 of barrel 592; and the contact between stakes 620 and surface 603 of barrel 592.

In the joinder of male connector 30 and female contact assembly 570 during loadmake, one connector is energized and the other is engaged with a normal load. Upon the attempted closure of male contact probe 40 with female contact 590, an arc is struck prior to actual engagement of probe 40 with contact fingers 594 and continues until solid electrical contact is made. The arc passes from male contact probe 40 to arc snuffer 610 and passes along the inner circumferential surface 611 of arc snuffer 610 thereby causing the generation of arc-quenching gases. These gases are directed inwardly within the bore 591 of female contact 590 and the bore 588 of contact holder 580. The pressure of these gases applies a force to inwardly facing shoulder 62 1 of arc snuffer housing 600 and to the inner terminal end 622 of female contact 590. An arc of moderate intensity will not produce adequate gas pressure to apply sufficient force on the end 624 of arc snuffer housing 600, inner end 619 of arc snuffer 610 and terminal end 622 of female contact 590 to overcome the inhibitor means.

However, during fault closure, either the male or female connector is energized and the other is engaged with a load having a fault, e.g. a short circuit condition. Under such circumstances, a substantial arcing occurs between male contact probe 40 and female contact 590 as probe 40 approaches opening 626 in arc snuffer 610. In fault closure, arc snuffer 610 generates substantial arc-quenching gases which produce a gas pressure within bore 588 that is sufficient to act upon shoulder 621 of the are snuffer assembly and the terminal end 622 of female contact 590 and overcome the frictional and mechanical engagement of the inhibitor means. Upon overcoming the inhibitor means, the arc-quenching gas pressure moves the entire contact assembly 570, i.e. arc snuffer housing 600, arc snuffer 610, and female contact 590, toward probe 40 to more quickly establish electrical contact between male contact probe 40 and female contact fingers 594. As the barrel 592 of female contact 590 moves outwardly towards probe 40, stop shoulder 606 first engages the stakes 620 and in particular engages the inclined surface 623 of stakes 620. The enlarged diameter knurled end 598 of barrel 592 is inhibited as it wedges and attempts to pass through counterbore 602 beneath stakes 620. Should the gas pressures produced by the arc snuffer 610 be sufficiently large to pass knurled surface 598 beneath stakes 620, annular stop surface 606 will then engage stops 604 to prevent further movement of the female contact 590 within contact holder 580. The stakes 620 and stops 604 provide sufficient stop barriers to the movement of female contact 590 to prevent female contact 590 from passing completely through cylindrical bore 588 of contact holder 580. The accelerated electrical connection reduces the fractional time required to make connection and thus reduces the possibility of explosion and any accompanying hazard to operating personnel during a fault closure situation.

Figure 9:
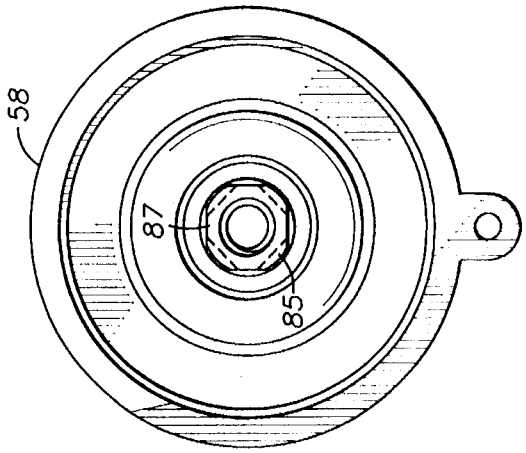
FIG. 9 is an end view of the alternative female contact connector shown in FIG. 8.
Figure 8:
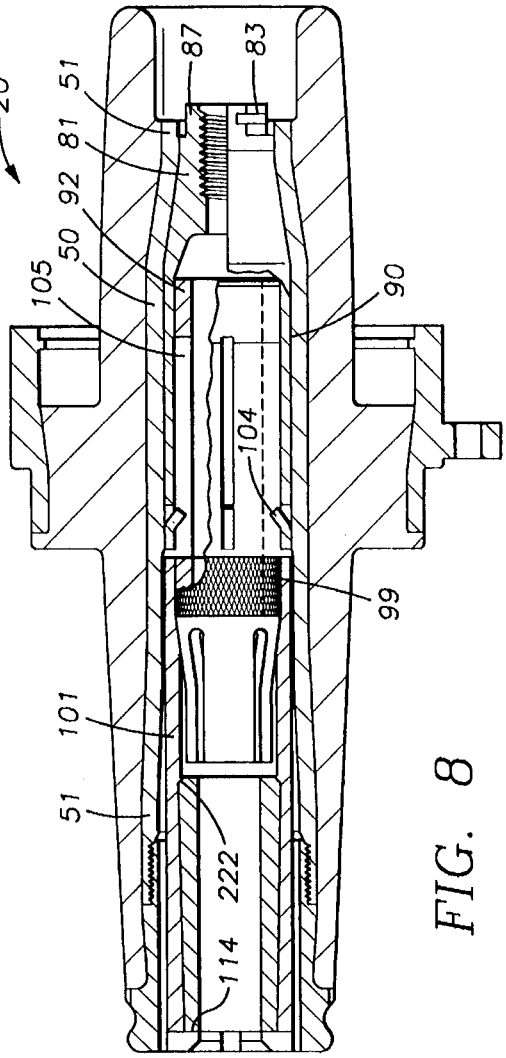
FIG. 8 is a cross-sectional side elevational view of an alternative embodiment of the female contact connector shown in FIGS. 1–7.

Referring now to FIGS. 8 and 9, there is illustrated various alternative constructions of the female contact connector shown in FIGS. 1–7. Arc snuffer housing 101 has been molded around are snuffer 110 such that arc snuffer 110 is disposed between an annular outer shoulder 114 and an annular inner tang 222. Arc snuffer housing 101 is also shown molded around an outer knurled surface 99 of female contact 90. Annular stops 104 are shown being received within longitudinal slots 105 in barrel 92 of contact 90. The inner end 51 of sleeve 50 is also shown intefferringly fit around the inner end 81 of contact holder 80. Contact holder 80 is held in position by a snap ring 83 received within a groove 85 around the terminal end 87 of holder 80. It should be appreciated that one skilled in the art may make other modifications to the embodiment shown in FIGS. 1–7 without departing from the spirit of the invention.

FIGS. 10–20 illustrate alternative embodiments of the female contact connector 20 of the present invention. In the description which follows of the alternative embodiments, like parts to the preferred embodiment are marked throughout the specification and drawings with the same reference numerals, respectively. The drawings are not necessarily to scale and certain features and certain views of the drawings may be shown exaggerated in scale or in schematic form in the interest of clarity and conciseness.

Figure 10:
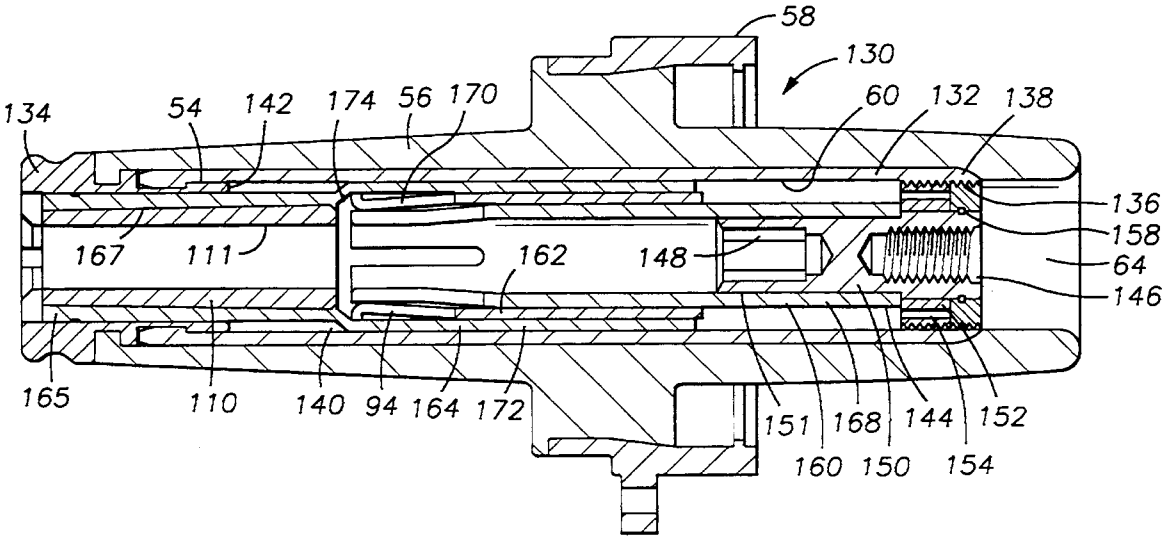
FIG. 10 is a cross-sectional side elevational view of an alternative embodiment of the female contact connector of the present invention.
Figure 11:
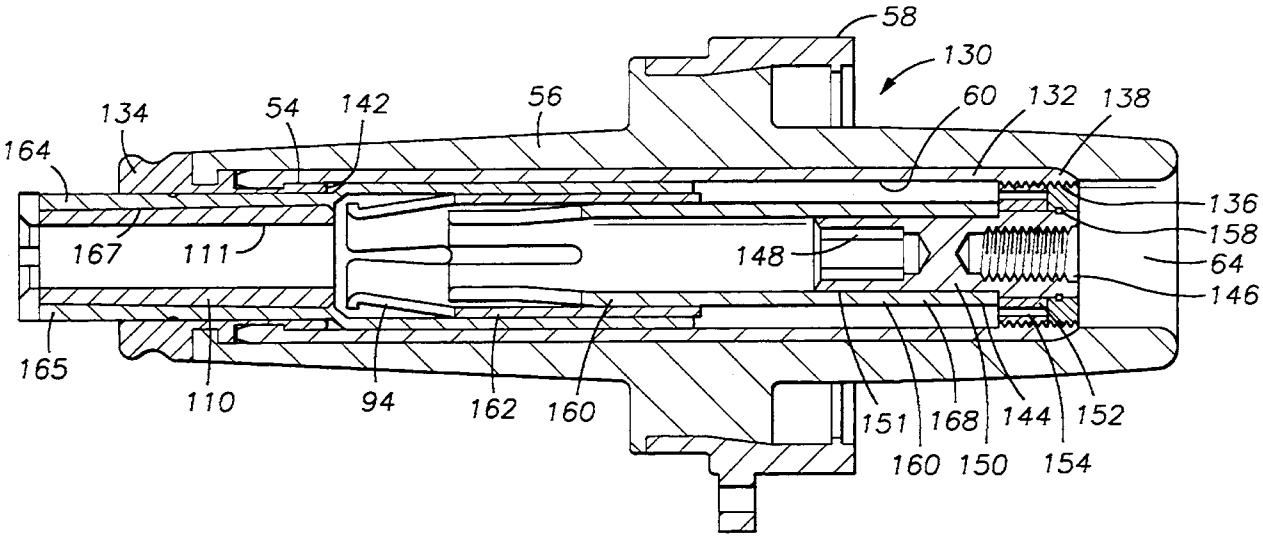
FIG. 11 is a cross-sectional side elevational view of the female contact connector shown in FIG. 10 in the outward, expanded position.

Referring now to FIGS. 10 and 11, a first alternative embodiment of the female contact connector of the present invention is shown. The first alternative female contact connector 130 includes a conductive sleeve 132 having a non-conductive nose piece 134 secured to one end of sleeve 132 by latch means 54, and a casing 56 bonded to the outer surface of sleeve 132 and a portion of nose piece 134. Female contact connector 130 also includes a radial outer portion 58.

Sleeve 132 is generally cylindrical having a central passageway 60 therethrough. Sleeve 132 has an inner end 138 which opens adjacent recess 64 in casing 56 and includes internal threads 136. The other end of sleeve 132 includes an annular shoulder and groove for latching engagement with the mating annular groove and shoulder of nose piece 134. Nose piece 134 forms an inwardly facing annular frustoconical shoulder 142 which serves as a stop shoulder for contact assembly 140 as hereinafter described.

Female contact connector 130 further includes a contact assembly 140. Contact assembly 140 includes a contact holder 150, a stationary female contact 160, a sliding female contact 162, an arc snuffer housing 164, and an arc snuffer 110. Contact assembly 140 is disposed within internal passageway 60 of conductive sleeve 132. Contact holder 150, as distinguished from cylindrical contact holder 80 of the preferred embodiment, is a shaft-like end plug having an enlarged diameter end forming an inwardly facing annular shoulder 144. A threaded bore 146 passes into the inner end of contact holder 150 for threading engagement to a stud (not shown) extending from the bushing well. A collar 152 is press fitted over the enlarged diameter inner end of holder 150 and includes a plurality of pressure relief holes 154. External threads are provided around collar 152 for threaded engagement with threads 136 on sleeve 50. A snap ring 158 is received within a groove in the outer end of holder 150 to maintain contact holder 150 within conductive sleeve 132. A hex slot 148 is provided in the outer end of holder 150 to receive a hexrod for threading collar 152 to sleeve 50. Threaded bore 146 and hex slot 148 are centered on the central axis 85 of sleeve 132. The inwardly projecting portion 151 of contact holder 150 has an outer diameter sized to be press fitted into the open cylindrical end of stationary female contact 160. Contact 160 is also staked to holder 150. The inner terminal end of female contact 160 abuts annular shoulder 144 of holder 150.

Pressure relief holes 154 prevent the trapping of air in recess 64 between female contact connector 130 and the bushing well (not shown). As connector 130 is threaded into the bushing well, air is allowed to pass through relief holes 154 from recess 64. Trapped air in recess 64 could hinder the assembly of contact connector 130 to the bushing well.

Female contact 160 includes a barrel portion 168 which receives projecting portion 15 1 of contact holder 150, and a plurality of projecting contact fingers 94. The barrel 168 is affixed to contact holder 150 and therefore is stationary within conductive sleeve 132.

Sliding female contact 162 is generally cylindrical so as to be received over the outer end of stationary female contact 160 having fingers 94. That portion of the outer circumferential surface of contact 160 engaging contact 162 is knurled to provide frictional engagement. Sliding female contact 162 is in electrical engagement with stationary female contact 160. Sliding female contact 162 also includes a plurality of azimuthally spaced fingers 170 which are disposed exteriorly of and adjacent to fingers 94 on stationary female contact 160 in the normal, contracted position of contact assembly 140 shown in FIG. 10.

Tubular arc snuffer housing 164 is generally cylindrical and includes an enlarged diameter portion 172 which is sized to slidingly receive sliding female contact 162 together with the outer end of stationary female contact 160 having contact fingers 94. The change in diameter of tubular sleeve 164 forms an inwardly facing frusto-conical shoulder 174 which is adjacent to the terminal ends of contact fingers 170 on sliding female contact 162. The outer portion 165 of arc snuffer housing 164 has the smaller diameter and is sized to be slidingly received within nose piece 134. The inner surface is tapered slightly so as to form a conical wall 167. The arc-quenching, gas-generating arc snuffer 110 has a correspondingly tapered outer conical surface so as to conform with the interior conical wall 167 of arc snuffer housing 164. Arc snuffer 110 includes a cylindrical inner bore 111 for receiving probe 40.

Referring now to FIGS. 10 and 11, sliding female contact 162 is activated on fault close only. As the male contact probe 40 approaches sliding female contact 162 and stationary female contact 160 and a short circuit condition exists, an arc is struck which passes along the inner circumferential surface 111 of arc snuffer 110 causing the generation of arc-quenching gases which are directed within the bore of stationary female contact 160. The pressure of the gases acts upon the arc snuffer assembly causing sliding female contact 162, arc snuffer housing 164, and arc snuffer 110 to move outward as shown in FIG. 11 toward the opening of bore 60 and probe 40 to establish electrical contact between sliding female contacts 170 and male contact probe 40.

Figure 12:
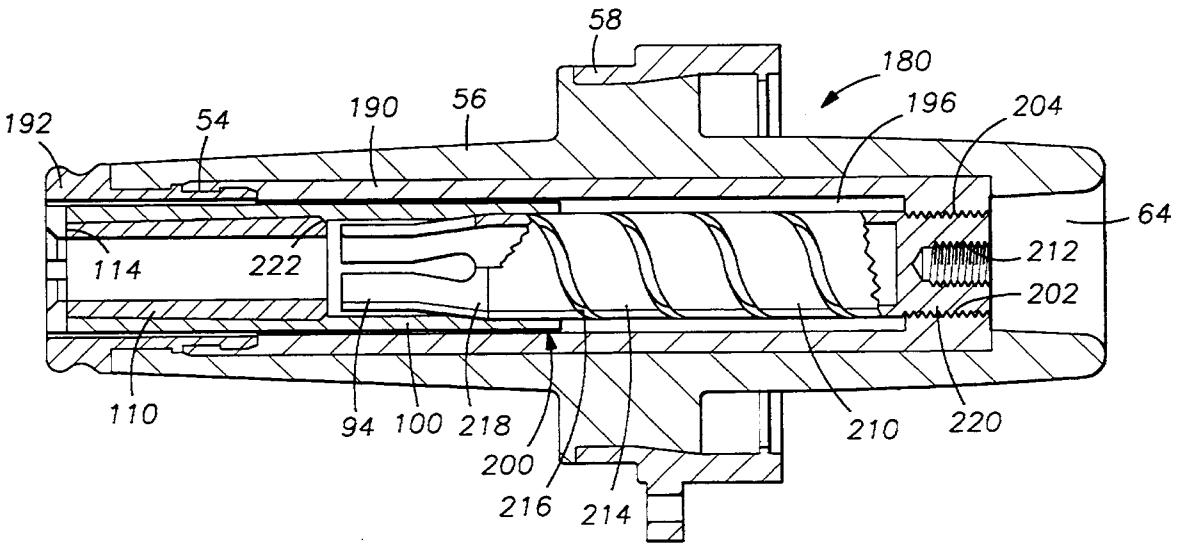
FIG. 12 is a cross-sectional, side elevational view of another alternative embodiment of the female contact connector of the present invention.
Figure 13:
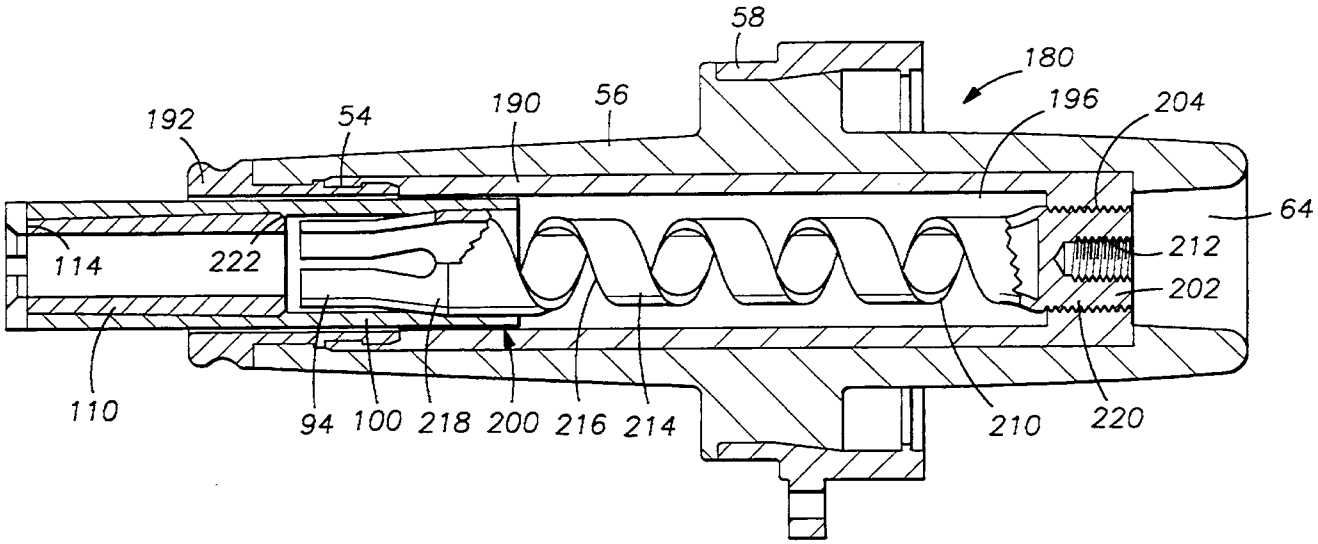
FIG. 13 is a cross-sectional, side elevational view of the female electrical connector of FIG. 12 shown in the outward, expanded position.

Referring now to FIGS. 12 and 13, there is shown another alternative embodiment of the female contact connector of the present invention. This alternative female contact connector 180 includes a conductive sleeve 190 having a non-conductive nose piece 192 secured to one end of sleeve 190 by a latching means 54, and a casing 56 bonded to the outer surface of sleeve 190 and a portion of nose piece 192. The conductive sleeve 190 is generally cylindrical forming a bore 196. Latching means 54 includes corresponding annular grooves and latching shoulders on the inner terminal end of nose piece 192 and outer terminal end of conductive sleeve 190 which latch together to form means 54.

As shown in FIG. 12, female contact connector 180 includes a contact assembly 200. Contact assembly 200 includes an integral contact holder/female contact 210, a tubular arc snuffer housing 100, and an arc-quenching, gas-generating arc snuffer 110. Contact holder/female contact 210 includes an inner contact holder end 220 having external threads 202 threadingly engaging at 204 internal threads on the inner end of conductive sleeve 190. Contact holder end 220 includes a threaded bore 212 for threading engagement with a stud (not shown) extending from the bushing well.

The integral contact holder/female contact 210 includes a spiraled tubular body 214 disposed within the straight walled cylindrical bore 196 of conductive sleeve 190. Tubular body 214 is spirally cut therearound at 216 to allow tubular body 214 to be extended outwardly as shown in FIG. 13. The outer end 218 of contact holder/female contact 210 includes a plurality of azimuthally spaced contact fingers 94. The arc snuffer housing 100 receives contact fingers 94 and is mounted on outer end 218 by melting the plastic of housing 100 around an external knurled surface circumscribing end 218. Arc snuffer 110 is molded within plastic housing 100 between shoulder 114 and annular tang 222. The common walls of arc snuffer housing 100 and arc snuffer 110 are conically shaped as shown.

FIG. 12 illustrates the normal contracted position of female contact connector 180. The spiral tubular body 214 of integral contact holder/female contact 210 is in its normal position. As shown in FIG. 13, during fault closure, the pressurized gas builds within bore 196 to move the arc snuffer assembly mounted on outer end 218 of contact holder/female contact 210 to the outer outward, expanded position. As end 218 moves outward, spiral tubular body 214 becomes elongated as it extends to the outer position. The spiral cuts 216 around tubular body 214 allow body 214 to collapse and expand longitudinally as the spirals tighten thereby allowing elongation.

Figure 14:
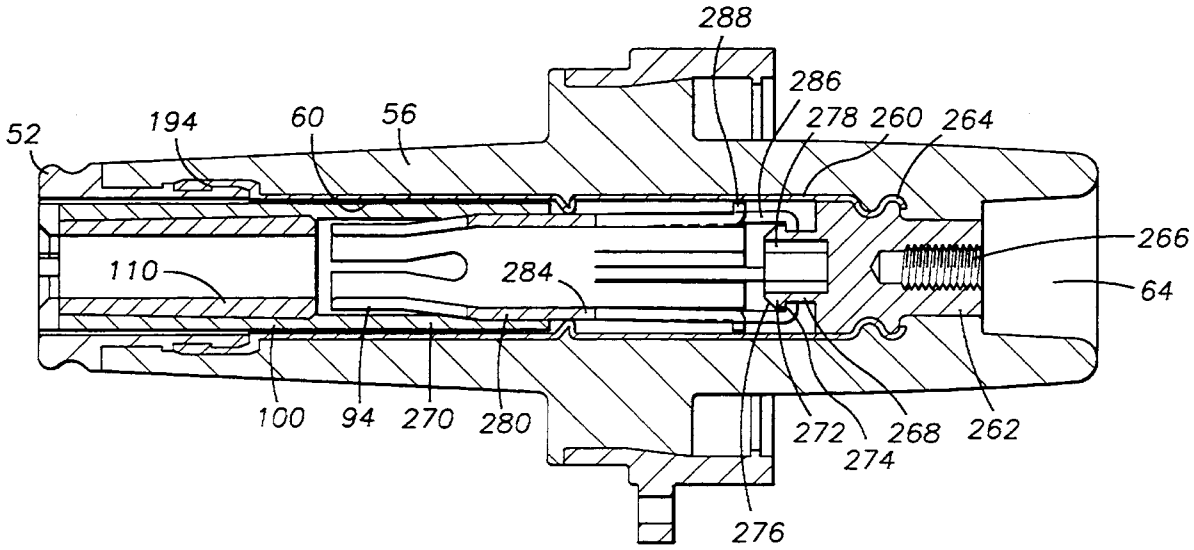
FIG. 14 is a cross-sectional, side elevational view of still another alternative embodiment of the female contact connector of the present invention.
Figure 15:
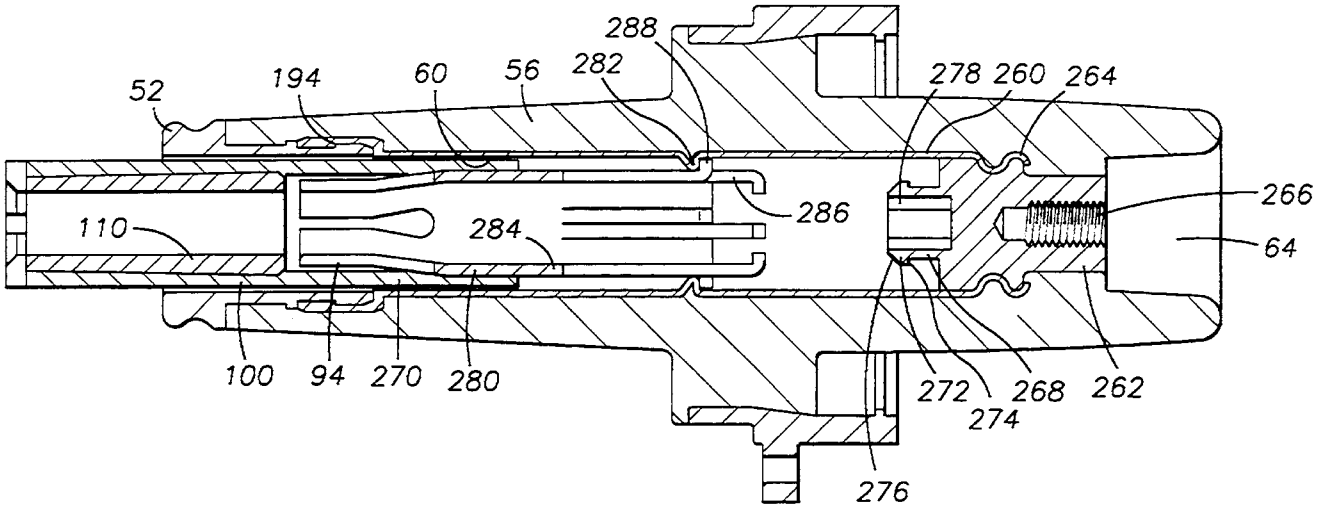
FIG. 15 is a cross-sectional, side elevational view of the female contact connector shown in FIG. 14 with the connector in its outward, expanded position.

Referring now to FIGS. 14 and 15, there is shown still another alternative embodiment of the female contact connector of the present invention. This embodiment of the female contact connector 250 includes a conductive sleeve 260 having a non-conductive nose piece 52 secured to one end of sleeve 260 by latching means 54, and a casing 56 surrounding and bonded to the outer surface of sleeve 260, a portion of nose piece 52 and a portion of contact holder 262, hereinafter described. The female contact connector 250 further includes a female contact assembly 270 which includes the contact holder 262, a female contact 280, a arc snuffer housing 100 and an arc-quenching, gas-generating arc snuffer 110.

Sleeve 260 is generally cylindrical forming a central inner passageway 60 therethrough. Contact assembly 270 is disposed within passageway 60 of conductive sleeve 260. Sleeve 260 includes an inwardly and radially projecting annular shoulder 282 at its mid-portion which slidingly engages the external surface of female contact 280. The contact holder 262 is inserted into the inner terminal end 264 of sleeve 260 with end 264 mechanically formed around contact holder 262 to affix holder 262 within conductive sleeve 260. Contact holder 262 includes a threaded bore 266 for thread engagement with a stud (not shown) extending from the bushing well.

A neck 268 projects from the outer end of contact holder 262 into bore 60 of conductive sleeve 260. Neck 268 includes an enlarged diameter head 272 on its terminal end forming an inwardly facing annular shoulder 274 and an outwardly facing conical shoulder 276. A hex slot 278 extends into neck 268 for receiving a hexrod (not shown).

Female contact 280 includes a plurality of azimuthally spaced contact fingers 94 on its outer end which is secured within the inner end of arc snuffer housing 100 by heating contact 280 and melting housing 100. The inner end 284 of female contact 280 includes a plurality of inwardly directed mechanical flanges 286 and a plurality of outwardly directed mechanical flanges 288. The mechanical flanges 286, 288 are disposed on longitudinal arms cut in the circumferential wall of female contact 280 with inwardly directed mechanical flanges 286 having a greater longitudinal length than outwardly directed mechanical flanges 288 thereby projecting further from female contact 280. In the normal, contracted position as shown in FIG. 14, the inwardly directed mechanical flanges 286 cam outward upon engagement of conical shoulder 276 so as to become in abutting engagement with inwardly facing annular shoulder 274. Outwardly extending mechanical flanges 288 are adapted to engage annular shoulder 282 of conductive sleeve 260 upon the outward movement of female contact assembly 270 as shown in FIG. 15.

Referring now to FIG. 15, during fault closure, the arc-quenching gases are directed within the bore 60 shearing inwardly directed mechanical flanges 286 and onto arc snuffer assembly and causing the contact assembly 270 to travel outwardly as shown in FIG. 12 until outwardly directed mechanical flanges 288 engage annular shoulder 282.

Figure 16:
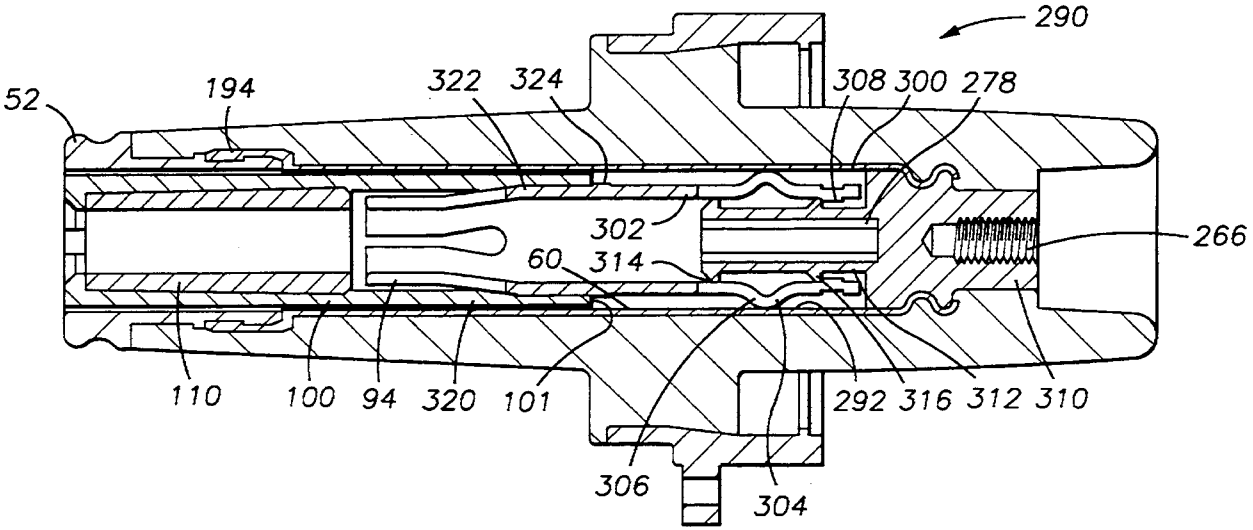
FIG. 16 is a cross-sectional, side elevational view of still another embodiment of the female contact connector of the present invention.
Figure 17:
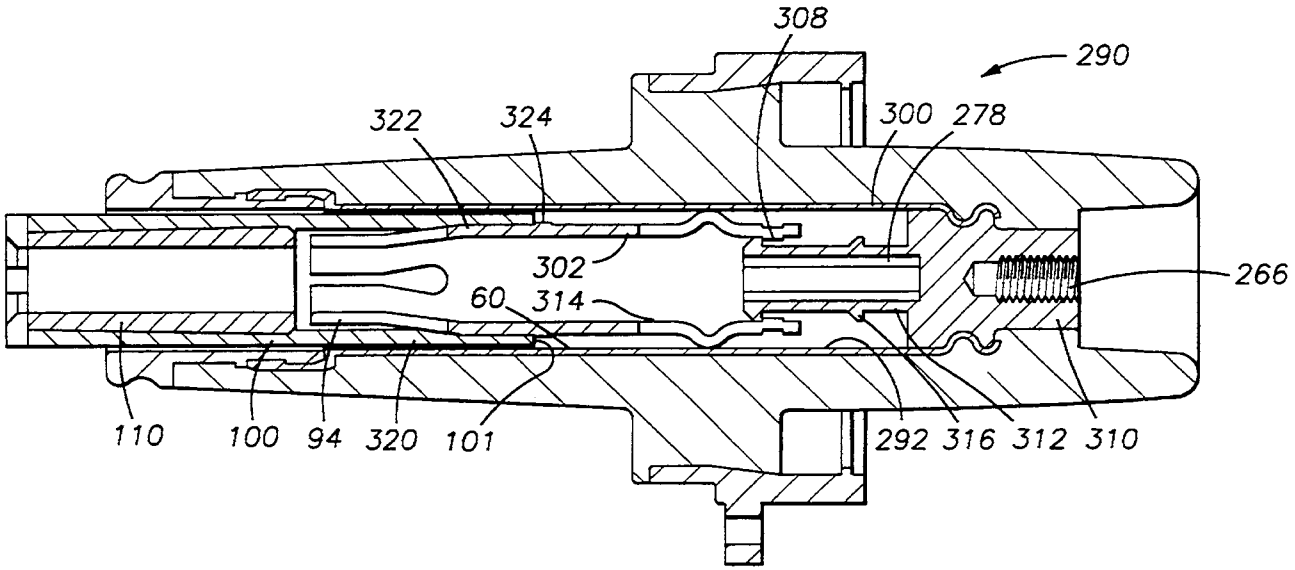
FIG. 17 is a cross-sectional, side elevational view of the female contact connector of FIG. 16 shown in the outward, expanded position.
Figure 19:
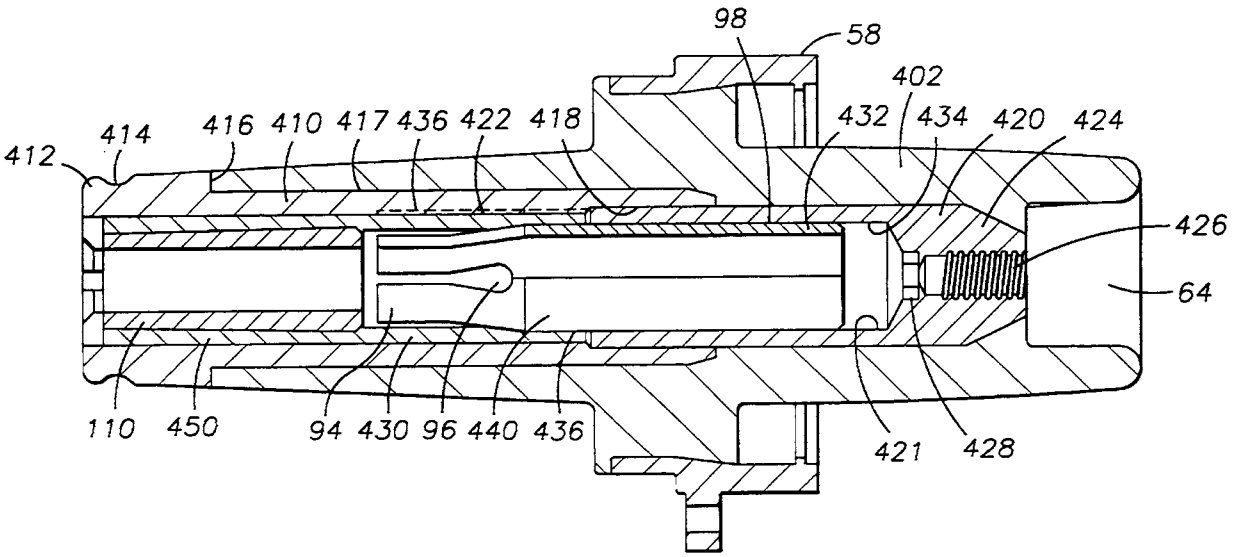
FIG. 19 is a cross-sectional, side elevational view of still another embodiment of the female contact connector of the present invention.

Referring now to FIGS. 16 and 17, there is shown a still another alternative embodiment of the female contact connector of the present invention. This alternative female contact connector 290 includes a conductive sleeve 300 which is substantially the same as sleeve 260 of the embodiment with the exception that conductive sleeve 300 does not include an inwardly directed annular shoulder at its midpoint. Conductive sleeve 300 includes a non-conductive nose piece 52 attached to one end by latching means 194 and its other end is attached to end plug 310 in a manner identical to that of the alternative embodiment shown in FIGS. 14 and 15. The female contact connector 290 further includes a contact assembly 320. Contact assembly 320 includes a contact holder 310, a female contact 322, a arc snuffer 100, and an arc-quenching, gas-generating guide tube 110. The contact assembly 320 is disposed within internal passageway 60 of conductive sleeve 300.

Contact holder 310 includes a threaded bore 266 and a neck 312 projecting into the bore 60 of conductive sleeve 200 like that of the embodiment shown in FIGS. 14 and 15. Neck 3 12 includes an outer annular shoulder 314, substantially the same as annular head 272 shown in FIGS. 14 and 15, and also includes an inner annular head 316 located around the medial portion of neck 312. Each of the annular heads 314, 316 include an outwardly facing conical shoulder and an inwardly facing abutting shoulder.

Female contact 322 includes a plurality of azimuthally spaced contact fingers 94 on its outer end which is secured within one end of arc snuffer 100. Female contact 322 further includes a plurality of tangs 324 projecting radially outward around its mid-portion for engagement with the inner terminal end 101 of arc snuffer 100. The inner end 302 of female contact 322 includes a plurality of arms 304 formed by longitudinal slots in the walls of female contact 322. Each arm 304 includes a radially projecting raised portion 306 which engages the interior circumferential wall of conductive sleeve 300. Adjacent the terminal end of arms 304, there is stamped an inwardly projecting tang 308 adapted for engagement with annular heads 314 and 316 of contact holder 310.

Referring now to FIGS. 16 and 17, the inwardly directed tangs 308 engage the inner annular head 316 on neck 312 of contact holder 310 in the normal, contracted position. Upon fault closure, the arc-quenching gases are directed within the bore 60 expanding arms 304 and causing the tangs 308 to disengage annular head 316. Tangs 308 then become engaged with annular head 314 to limit the outward movement of contact assembly 320.

Figure 18:
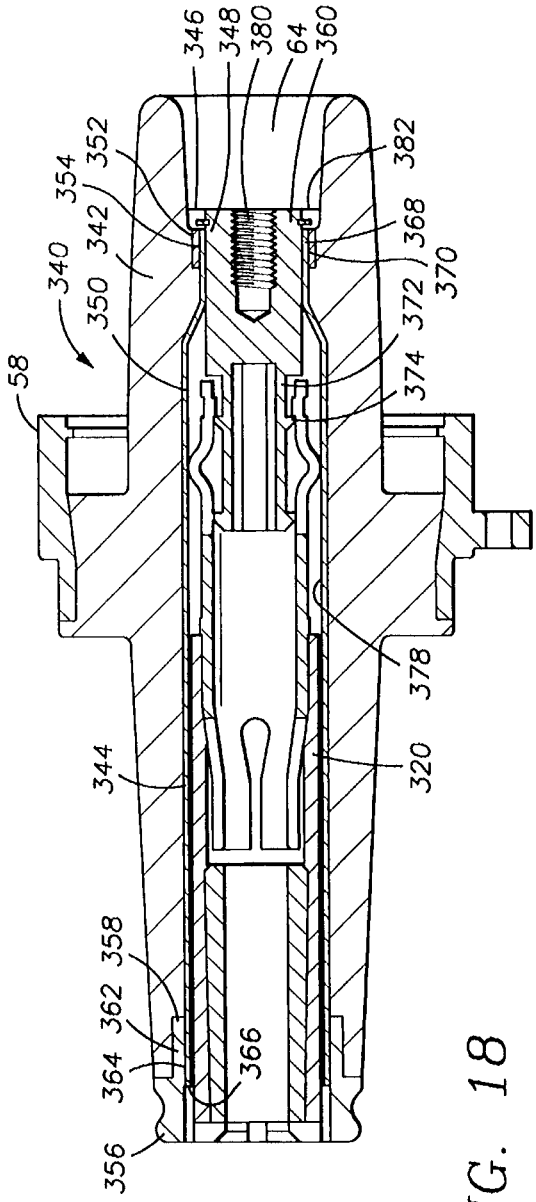
FIG. 18 is a cross-sectional, side elevational view of the female contact connector shown in FIGS. 16 and 17 having a molded rubber casing.

Referring now to FIG. 18, there is an alternative to the embodiment shown in FIGS. 16 and 17. In this alternative, modifications have been made to the conductive sleeve and contact holder to allow assembly after the rubber components, such as the casing, have already been molded. In all previous embodiments, the elastomeric, insulating casing 56 has been bonded to the outer surface of the conductive sleeve and a portion of the nose piece after the assembly of the sleeve and nose piece. As shown in FIG. 18, the female contact connector 340 includes an elastomeric insulating casing 342 having a generally cylindrical bore 344 therethrough and a reduced diameter portion 346 which forms a neck with a bore 348 therethrough. Bore 348 opens into recess 64 to receive a portion of the bushing well (not shown). A threaded collar 352 is molded and bonded within the portion 346 such that threads 354 interiorly of the collar 352 are adapted for threaded engagement with the inner end of conductive sleeve 350 as hereinafter described. Collar 352 centers sleeve 350. The nonconductive nose piece 356 is also molded and bonded to casing 342 and includes a neck down portion 358 which is received by a counterbore 362 in the outer terminal end of casing 342. Non-conductive nose piece 356 is not connected to conductive sleeve 350 during the molding of casing 342.

Conductive sleeve 350 is generally cylindrical having external threads for threaded engagement with nose piece 356 and a reduced diameter portion 368 at its inner end having external threads 370 adapted for threaded engagement with the internal threads 354 of collar 352.

The contact holder 360 includes a rod-like body having a neck 372 with annular heads 374, 376 projecting into the bore 378 of conductive sleeve 350. A tapped bore 380 extends into the inner end of holder 360 for receiving a stud (not shown) extending from the bushing well. The neck 346 of sleeve 342 and the inner end of holder 360 have aligned snap ring grooves for receiving a snap ring 382 to secure holder 360 within neck 346 and thus casing 342. The female contact assembly 320 shown in FIG. 16 may be used with this alternative embodiment.

Referring now to FIGS. 19–23, there is shown still another alternative embodiment of the female contact connector of the :present invention. This embodiment of the female connector 400 includes an integral bushing nose/non-conductive sleeve 410 made of a non-conductive material. A casing 402 of elastomeric insulating material surrounds and is bonded to the outer surface of nose/non-conductive sleeve 410 and a portion of contact holder 420 as hereinafter described. The nose 412 includes a circumferential external groove 414 which serves as a securing detente for complimentary fib portion 33 associated with the elastomeric housing 32 of male contact connector 30. The bushing nose/non-conductive sleeve 410 includes a reduced outer diameter cylindrical body 4 17 forming an inwardly facing annular shoulder 416. The cylindrical body 417 includes an enlarged inner diameter counterbore 418 at its inner end for receiving the outer end of contact holder 420 as hereinafter described. The interior and exterior of the counterbore 418 is coated with a semi-conductive material making electrical contact with the outer end of contact holder 420. The inner cylindrical wall 438 of nose/non-conductive piece 410 includes a pair of J-slots 422 for receiving arc snuffer housing 450 as hereinafter described.

The female contact connector 400 further includes a contact assembly 430. Contact assembly 430 includes a contact holder 420, a female contact 440, a arc snuffer housing 450, and an arc-quenching, gas-generating arc snuffer 110. Contact assembly 430 is disposed within the casing 402 and nose/non-conductive sleeve 410.

Contact holder 420 is generally cylindrical having a central passageway 60 therethrough. Holder 420 has a tapered inner end 424. Tapered inner end 424 includes a threaded bore 426 open to recess 64 to receive a portion of the bushing well (not shown). A hex slot 428 is provided to receive a hexrod for turning the assembly to threadingly engage a stud (not shown) extending from the bushing well. The open end of contact holder 420 is received within the enlarged diameter end 418 of nose piece/sleeve 410.

The female contact 440 is generally cylindrical and includes a barrel 432 having a plurality of projecting contact fingers 94 extending from its outer end. Female contact fingers 94 are formed by a plurality of slots 96 around barrel 432. The inner end of female contact 440 is knurled at 98 around its outer surface to provide a biting and frictional engagement with the inner circumferential wall 434 of contact holder 420. The knurled surface 98 ensures good electrical contact between contact holder 420 and female contact 440 and also inhibits the reciprocation of female contact 440 within the bore 421 of contact holder 420. The female contact 440 is also knurled at 436 for disposal within arc snuffer housing 450.

Figure 21:
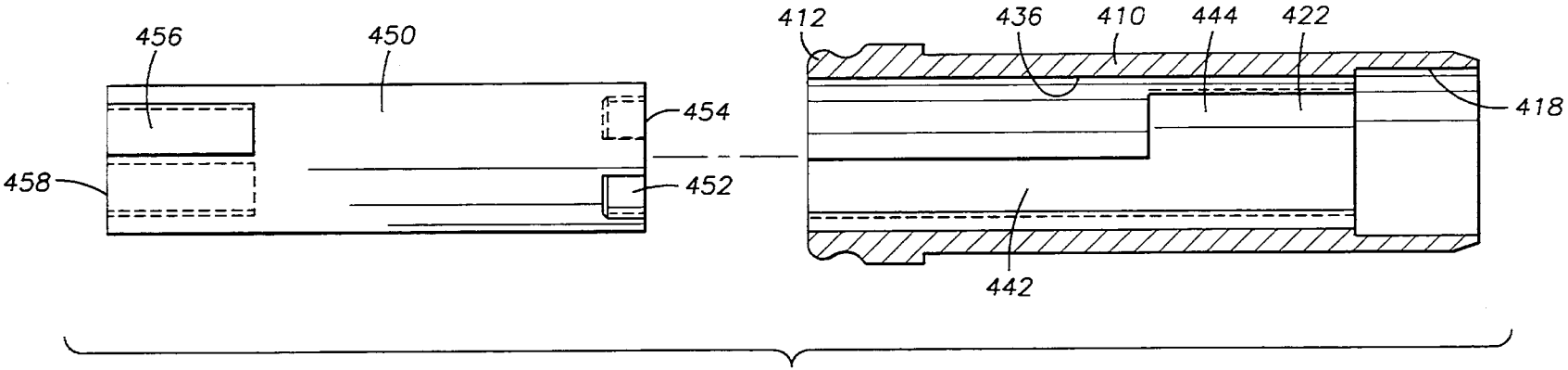
FIG. 21 is an exploded view of the arc snuffer housing to be assembled within the conductive sleeve of the female contact connector shown in FIGS. 19 and 20.
Figure 22:
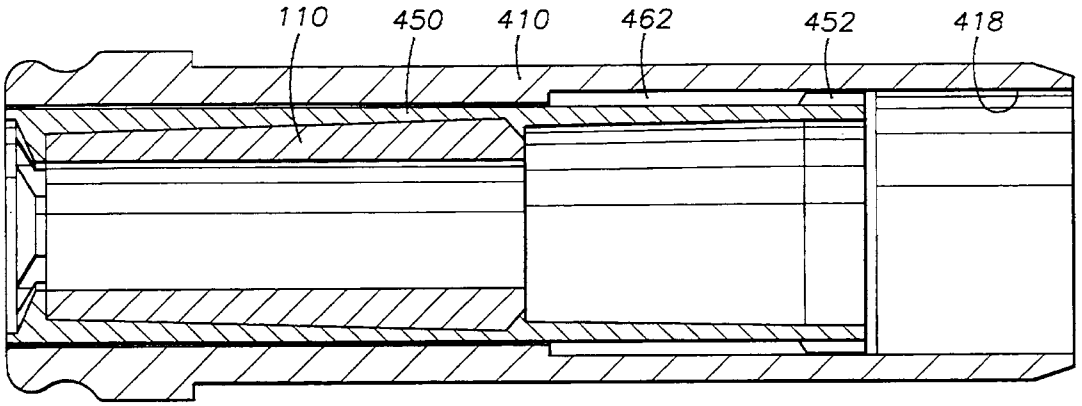
FIG. 22 is a cross-sectional view of the arc snuffer housing disposed within the conductive sleeve shown in FIGS. 19 and 20.
Figure 23:
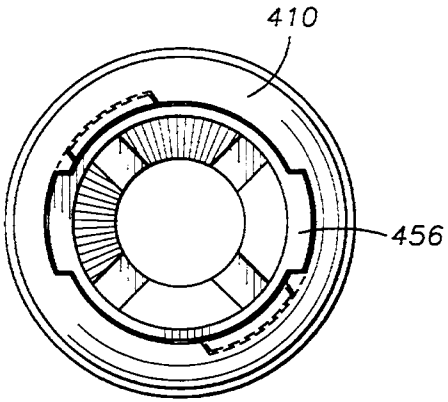
FIG. 23 is an end view of the assembly shown in FIG. 22.

The fault close stopping mechanism is a twist lock design incorporated into the nose/nonconductive sleeve 410 and arc snuffer housing 450. As best shown in FIG. 21, the J-slots 422 in the internal wall 438 of nose/non-conductive sleeve 410 each include a longitudinal portion 442 and a transverse portion 444. The longitudinal portion 442 extends from the terminal end at nose bushing 412 to counterbore 418. Transverse portion 444 is adjacent counterbore 418. Arc snuffer housing 450 includes a pair of transverse keys 452 at its inner end 454 and a pair of longitudinal keys 456 at its outer end 458. As best shown in FIGS. 22 and 23, upon assembly, each transverse key 452 is aligned with the longitudinal portion 442 of a J-slot 422. Upon transverse key 452 entering the transverse portion 444 of J-slot 422, the arc snuffer housing 450 is twisted or rotated to move transverse key 452 into transverse portion 444 of J-slot 422 and thus align longitudinal key 456 with the longitudinal portion 442 of J-slot 422. The arc snuffer housing 450 is then further inserted into nose/non-conductive sleeve 410 with longitudinal key 456 being received by longitudinal portion 442 of J-slot 422. In this manner, arc snuffer housing 450 is incorporated into nose/non-conductive sleeve 410. Transverse key 452 has a longitudinal dimension substantially smaller than the longitudinal dimension of the transverse portion 444 of J-slot 422 thereby providing a clearance 462 best shown in FIG. 22. This clearance 462 allows arc snuffer housing 450 as a part of contact assembly 430, to move longitudinally within nose/non-conductive sleeve 410 during fault closure.

Figure 20:
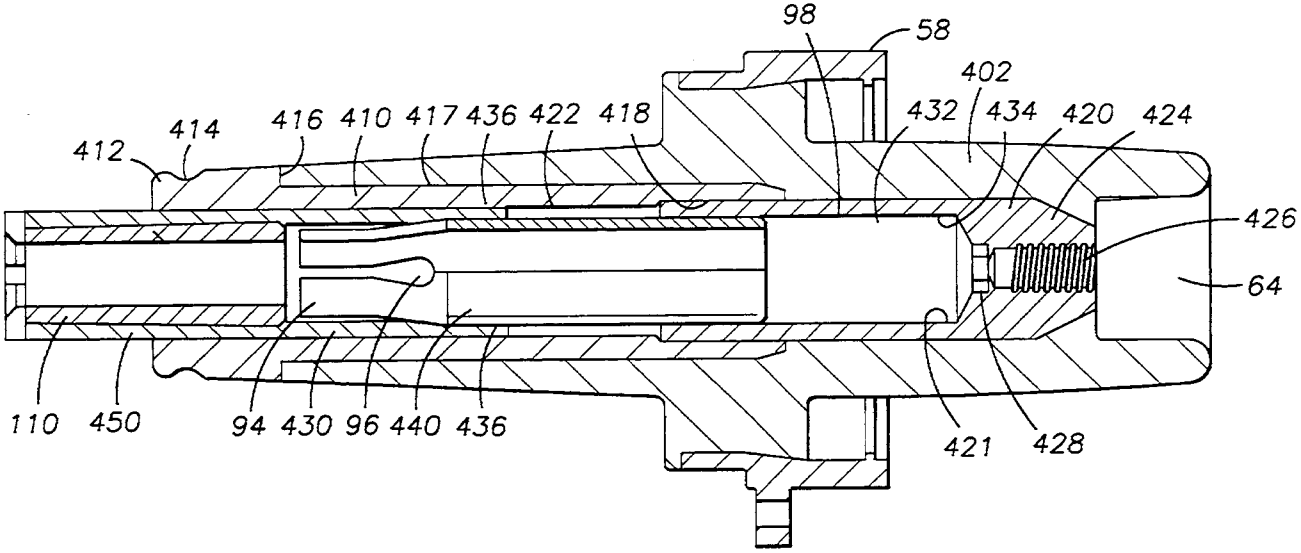
FIG. 20 is a cross-sectional, side elevational view of the female contact assembly shown in FIG. 19 in the outward, expanded position.

Referring now to FIG. 20, during fault closure, the arc-quenching gases are directed within the bore 421 applying a force to the terminal end of female contact 440 so as to overcome the frictional engagement of knurl surface 98 thereby causing the contact assembly 440 to travel outwardly as shown in FIG. 20 until reaching the fault closure stopping mechanism.

While a preferred embodiment of the invention has been shown and described, modifications thereof can be made by one skilled in the art without departing from the spirit of the invention.

We claim:

1. A connector for connecting or disconnecting an energized high voltage circuit by engagement or disengagement with another connector having a contact member, comprising:

a sleeve of electrical conductive material having an axial passage therethrough;

first and second contact elements disposed within said passage for engaging the contact member;

guide means attached to said first contact element for guiding the contact member towards said first contact element and for evolving an arc-quenching gas in response to an arc being struck between the contact member and said first contact element;

said first contact element including piston means responsive to such evolved gas for jointly displacing within said passage said guide means and said first contact element toward the contact member;

said second contact element fixedly secured within said sleeve for reciprocably supporting said piston means of said first contact element within said passage of said sleeve; and inhibitor means associated with said piston means for inhibiting the movement of said piston means and said first contact element within said sleeve until a predetermined pressure is achieved by the arc-quenching gas and for electrically engaging said piston means and said conductive sleeve for providing electrical continuity therebetween;

whereby said first contact element engages the contact member upon said arc-quenching gas producing a pressure greater than said pre-determined pressure and said second contact element engaging the contact member upon said arc-quenching gas producing a pressure less than said pre-determined pressure.

2. The connector of claim 1 further including means for supporting said second contact element within said conductive sleeve.

3. A connector for connecting or disconnecting an energized high voltage circuit by engagement or disengagement with another connector having a contact member, comprising:

an electrically conductive sleeve having an axial passage therethrough;

a contact element disposed within said passage for engaging the contact member;

guide means attached to one end of said contact element for guiding the contact member towards said contact element and for evolving an arc-quenching gas in response to an arc being struck between the contact member and said contact element;

said contact element including an expandable body having one end secured to said conductive sleeve;

said contact element further including a piston means responsive to such evolved gas for jointly displacing within said passage said guide means and said contact element toward the contact member by extending said expandable body of said contact element; and inhibitor means associated with said piston means for inhibiting the movement of said contact element within said sleeve until a pre-determined pressure is achieved by the arc-quenching gas and for electrically engaging said contact element with said conductive sleeve for providing electrical continuity therebetween.

4. The connector of claim 3 wherein said body includes a tube of malleable material having a helical slot cut therein.

5. A connector for connecting or disconnecting an energized high voltage circuit by engagement or disengagement with another connector having a contact member, comprising:

an electrically conductive sleeve having an axial passage therethrough and a first stop means;

a contact element disposed within said passage for engaging the contact member;

guide means attached to one end of said contact element for guiding the contact member towards said contact element and for evolving an arc-quenching gas in response to an arc being struck between the contact member and said contact element;

support means fixedly secured within said sleeve for reciprocably supporting one end of said contact element within said passage of said sleeve and having a second stop means;

said contact element including first engagement means for engaging said first stop means and second engagement means for engaging said second stop means;

said contact element including piston means responsive to such evolved gas for causing said second engagement means to release from said second stop means to jointly displace within said passage said guide means and said contact element toward the contact member until said first engagement means engages said first stop means; and inhibitor means associated with said piston means for inhibiting the movement of said piston means within said sleeve until a pre-determined pressure is achieved by the arc-quenching gas and for electrically engaging said piston means with said conductive sleeve for providing electrical continuity therebetween.

6. The connector of claim 5 wherein said first and second engagement means includes a plurality of inwardly and outwardly directed flanges for engagement with said first and second stop means.

7. The connector of claim 6 wherein said first stop means includes an annular shoulder on said support means and said second stop means includes an annular shoulder on said conductive sleeve.

8. The connector of claim 5 wherein said second engagement means shears upon said arc-quenching gas reaching said pre-determined pressure.

9. The connector of claim 7 wherein said annular shoulder also serves as a support means for supporting said contact element within said conductive sleeve.

10. A connector for connecting or disconnecting an energized high voltage circuit by engagement or disengagement with another connector having a contact member, comprising:

an electrically conductive sleeve having an axial passage therethrough;

a contact element disposed within said passage for engaging the contact member;

guide means attached to one end of said contact element for guiding the contact member towards said contact element and for evolving an arc-quenching gas in response to an arc being struck between the contact member and said contact element;

support means fixedly secured within said sleeve for reciprocably supporting one end of said contact element within said passage of said sleeve and having first and second stop means;

said contact element including an engagement means for engaging said first and second stop means;

said contact element including piston means responsive to such evolved gas for causing said engagement means to release from said first stop means to jointly displace within said passage said guide means and said contact element toward the contact member until said engagement means engages said second stop means; and inhibitor means associated with said piston means for inhibiting the movement of said piston means within said sleeve until a pre-determined pressure is achieved by the arc-quenching gas and for electrically engaging said piston means with said conductive sleeve for providing electrical continuity therebetween.

11. The connector of claim 10 wherein said one end of said contact element includes support means for supporting said contact element within said conductive sleeve.

12. The connector of claim 10 wherein said contact element includes means for impinging on the guide means to move the guide means with said contact element.

13. The connector of claim 10 further including a preformed elastomeric housing for receiving said conductive sleeve.

14. The connector of claim 13 wherein said housing includes means for securing said conductive sleeve within said housing.

* * * * *